US010072468B2

(12) United States Patent
Heiden et al.

(10) Patent No.: US 10,072,468 B2
(45) Date of Patent: Sep. 11, 2018

(54) MOTOR COOLING SYSTEM FOR CHILLERS

(71) Applicant: Trane International Inc., Piscataway, NJ (US)

(72) Inventors: Richard Heiden, Holmen, WI (US); Chuck Roesler, La Crosse, WI (US)

(73) Assignee: Trane International Inc., Davidson, NC (US)

( * ) Notice: Subject to any disclaimer, the term of this patent is extended or adjusted under 35 U.S.C. 154(b) by 269 days.

(21) Appl. No.: 14/733,703

(22) Filed: Jun. 8, 2015

(65) Prior Publication Data

US 2015/0276282 A1 Oct. 1, 2015

Related U.S. Application Data

(63) Continuation of application No. PCT/US2013/073837, filed on Dec. 9, 2013.

(Continued)

(51) Int. Cl.

| | |
|---|---|
| ***F16C 37/00*** | (2006.01) |
| ***E21B 21/06*** | (2006.01) |
| ***B01D 35/28*** | (2006.01) |
| ***F25B 1/10*** | (2006.01) |
| ***F25B 31/00*** | (2006.01) |
| ***F04D 17/12*** | (2006.01) |
| ***F04D 25/06*** | (2006.01) |
| ***F04D 29/42*** | (2006.01) |
| ***F04D 29/58*** | (2006.01) |

(Continued)

(52) U.S. Cl.

CPC ..... *E21B 21/065* (2013.01); *B01D 35/28* (2013.01); *F04D 17/122* (2013.01); *F04D 25/0606* (2013.01); *F04D 29/4206* (2013.01); *F04D 29/5806* (2013.01); *F25B 1/053* (2013.01); *F25B 1/10* (2013.01); *F25B 31/008* (2013.01); *F04D 29/059* (2013.01); *F25B 2400/13* (2013.01)

(58) Field of Classification Search

CPC ..... E21B 21/065; B01D 35/28; F04D 17/122; F04D 25/0606; F04D 29/4206; F04D 29/5806; F04D 29/059; F25B 31/008

See application file for complete search history.

(56) References Cited

U.S. PATENT DOCUMENTS 2,793,506 A * 5/1957 Moody ..... F25B 1/10 310/54
2,854,296 A * 9/1958 Eberle ..... F01D 25/125 184/6.1

(Continued)

OTHER PUBLICATIONS

ISA/US International Searching Authority International Search Report and Written Opinion, PCT Application No. PCT/US13/73837, dated Apr. 21, 2014, 9 pgs.

*Primary Examiner* — Emmanuel Duke
(74) *Attorney, Agent, or Firm* — Taft Stettinius & Hollister LLP

(57) ABSTRACT

Cooling systems and methods for controlling the temperature of motors of gas compression systems of chillers are disclosed. Certain systems utilize a centrifugal, two stage compressor equipped with a motor between the stages. The cooling system provides a low velocity refrigerant spray on at least one or both ends of the motor without requiring additional pumping energy from the motor to deliver the refrigerant spray.

22 Claims, 10 Drawing Sheets

Related U.S. Application Data

(60) Provisional application No. 61/734,698, filed on Dec. 7, 2012.

(51) Int. Cl.
*F25B 1/053* (2006.01)
*F04D 29/059* (2006.01)

(56) References Cited

U.S. PATENT DOCUMENTS

| | | | | |
|---|---|---|---|---|
| 3,217,193 | A * | 11/1965 | Rayner | H02K 9/20 165/903 |
| 4,959,570 | A * | 9/1990 | Nakamura | H02K 9/19 310/45 |
| 6,579,078 | B2 | 6/2003 | Hill et al. | |
| 7,451,616 | B2 | 11/2008 | Ro | |
| 8,156,757 | B2 | 4/2012 | Doty et al. | |
| 8,188,625 | B2 * | 5/2012 | Fukushima | H02K 9/19 310/54 |
| 2005/0284173 | A1 | 12/2005 | de Larminat | |
| 2009/0205361 | A1 * | 8/2009 | James | F25B 43/00 62/510 |
| 2009/0229280 | A1 | 9/2009 | Doty et al. | |
| 2010/0006262 | A1 * | 1/2010 | Welch | F25B 31/006 165/104.11 |
| 2011/0048051 | A1 | 3/2011 | Duffy | |
| 2011/0296859 | A1 | 12/2011 | James et al. | |

* cited by examiner

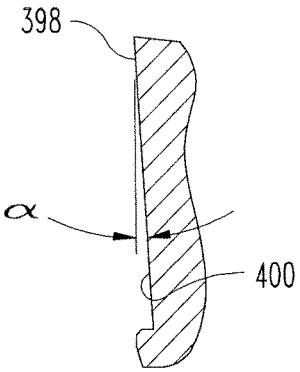
Fig. 27
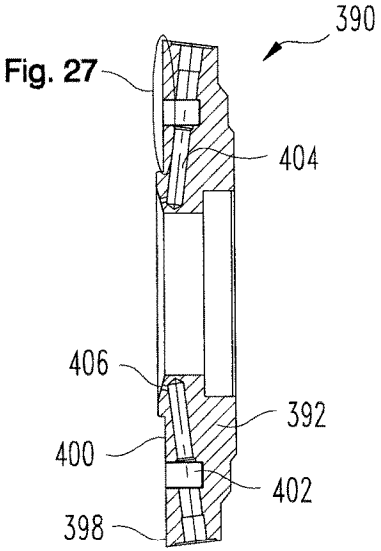
Fig. 26
Fig. 27
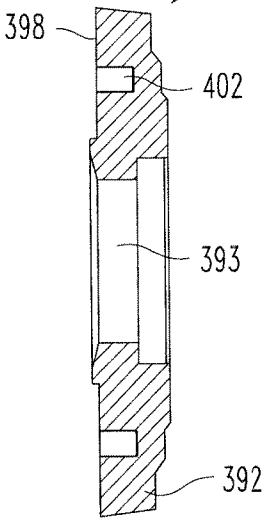
Fig. 25

MOTOR COOLING SYSTEM FOR CHILLERS

CROSS-REFERENCE TO RELATED APPLICATION

This application is a continuation of International Application Ser. No. PCT/US2013/073837, filed Dec. 9, 2013, which claims priority to, and the benefit of the filing date of, U.S. Provisional Application Ser. No. 61/734,698 filed on Dec. 7, 2012, each of which is incorporated herein by reference in its entirety.

BACKGROUND

Chillers are equipped with gas compression systems to compress refrigerant gas for cooling purposes. These systems employ motors to drive the compression mechanism for compressing the refrigerant gases. The size and type of motor employed in a particular system depends on several factors, such as the size and type of compressor, and the operating environment of the chiller. For example, systems may employ hermetic or semi-hermetic permanent magnet motors that offer a number of benefits for applications in which an electric motor is utilized to drive a refrigerant compressor, including enhanced efficiency, power density, and speed control precision. However, such motors also present challenges in providing adequate motor cooling. The temperature of the magnetic material of such motors must be controlled to avoid damage due to elevated temperature conditions which can arise, for example, from inadequate cooling or increased stator or rotor loss.

While various systems have been employed to provide motor cooling in a chiller system, some applications present a risk of chemical or mechanical attack on the magnets and other components by, for example, readily placing refrigerant in the air gap between the rotor and stator of the motor. Other applications provide inadequate cooling of the coil heads and other areas of the motor. Still other applications incorporate cooling fins that create high velocity impingement of refrigerant on the motor coils, increasing the possibility of wearing of the motor components and pumping energy losses. Thus, there is a need for the unique and inventive systems and methods for cooling of motors employed in the gas compression system of a chiller.

DISCLOSURE

For the purposes of clearly, concisely and exactly describing exemplary embodiments of the invention, the manner and process of making and using the same, and to enable the practice, making and use of the same, reference will now be made to certain exemplary embodiments, including those illustrated in the figures, and specific language will be used to describe the same. It shall nevertheless be understood that no limitation of the scope of the invention is thereby created, and that the invention includes and protects such alterations, modifications, and further applications of the exemplary embodiments as would occur to one skilled in the art to which the invention relates.

SUMMARY

Unique cooling systems and methods for cooling motors of a gas compression system of a chiller system are disclosed. Certain exemplary embodiments utilize a centrifugal compressor in a gas compression system equipped with a motor, and a cooling system for the motor that provides a low velocity refrigerant spray on at least one of the ends of the motor that does not require pumping energy to provide the refrigerant spray. Further embodiments, forms, objects, features, advantages, aspects, and benefits shall become apparent from the following description and figures.

BRIEF DESCRIPTION OF THE FIGURES

FIG. 25 is a section view of the distribution ring along line 25-25 of FIG. 24.

FIG. 26 is a section view of the distribution ring along line 26-26 of FIG. 24.

FIG. 27 is an enlarged view of a portion of the distribution ring of FIG. 26.

DETAILED DESCRIPTION

Figure 1:
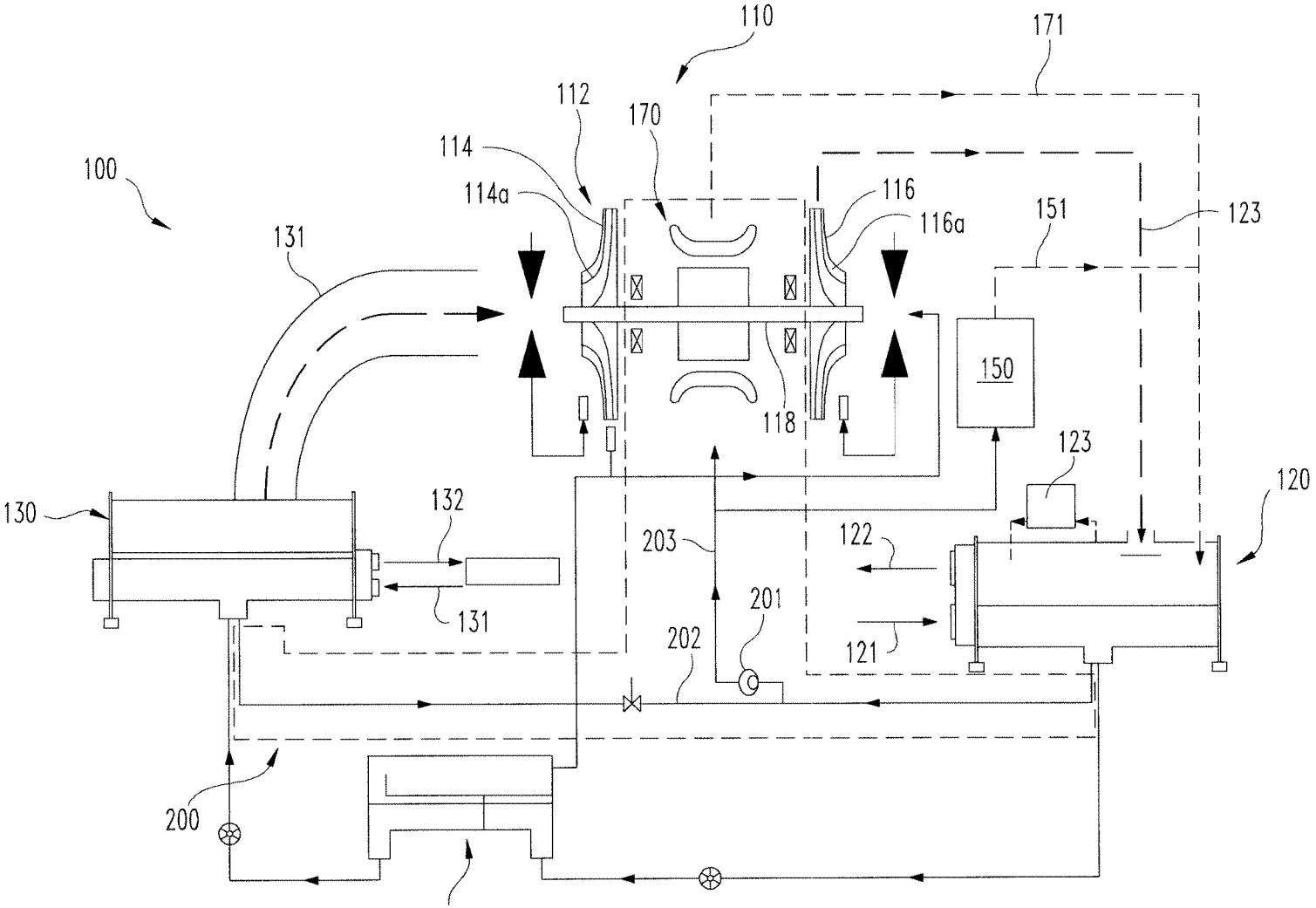
FIG. 1 is a schematic of an exemplary chiller system.

With reference to FIG. 1 there is illustrated a chiller system 100 which includes a refrigerant loop comprising a gas compression system 110, a condenser 120, an economizer 140, and an evaporator 130. Refrigerant flows through system 100 in a closed loop from gas compression system 110 to condenser 120 to economizer 140 to evaporator 130 and back to gas compression system 110. Various embodiments may also include additional elements which are not illustrated including, for example, valves for controlling refrigerant flow, refrigerant filters, pumps, and oil separator and/or cooling circuits for various system components.

Gas compression system 110 includes a two stage compressor 112 having a first stage 114 and a second stage 116 with impellers 114*a*, 116*a*, respectively, that are connected by a shaft 118. Shaft 118 is driven by an electric motor assembly 170 which is in turn driven by a variable frequency drive 150. In the illustrated embodiment, variable frequency drive 150 is configured to output a three-phase PWM drive signal, and motor assembly 170 includes a hermetic permanent magnet motor that rotates shaft 118 and bearing housings at the ends of the shaft 118 that are connected to respective ones of the first and second compressor stages 114, 116. Use of other types and configurations of variable frequency drives and electric motors is also contemplated. Additionally, other types of variable speed compressors could be used, for example, systems where variable compressor speed is provided using a transmission or other gearing, or by varying the pressure across a drive turbine.

Plumbing 123 connects compressor 110 to condenser 120. Condenser 120 is configured to transfer heat from compressed refrigerant received from compressor 110. In addition, plumbing 171 fluidly connects a housing of motor assembly 170 to condenser 120, and plumbing 151 fluidly connects a housing of drive 150 to condenser 120. Refrigerant that is heated due to cooling of motor assembly 170 and drive 150 is received by condenser 120. In the illustrated embodiment condenser 120 is a water cooled condenser which receives cooling water at an inlet 121, transfers heat from the refrigerant to the cooling water, and outputs cooling water at an output 122. Condenser 120 may also include a purge tank 124. It is also contemplated that other types of condensers may be utilized, for example, air cooled condensers or evaporative condensers.

Evaporator 130 is configured to receive and expand refrigerant from condenser 120 to decrease the refrigerant temperature, and then transfer heat from a received medium to the cooled refrigerant. In the illustrated embodiment evaporator 130 is configured as a water chiller which receives water provided to an inlet 131, transfers heat from the water to refrigerant, and outputs chilled water at an outlet 132. The amount of energy expended to cool the water is the system load. The refrigerant heated in evaporator 130 is received by compressor 112 via plumbing 131. Other types of evaporators and chiller systems are also contemplated, including dry expansion evaporators, flooded type evaporators, bare tube evaporators, plate surface evaporators, and finned evaporators among others. It shall further be appreciated that references herein to water include water solutions unless otherwise explicitly limited.

In the illustrated embodiment, economizer 140 is connected between condenser 120 and evaporator 130. Economizer 140 receives the cooled refrigerant from condenser 120 and may be designed to provide additional subcooling of refrigerant entering evaporator 130. Economizer 140 may also be connected to first and second stages 114*a*, 116*a* of compressor 112 to bypass evaporator 130 and direct a portion of refrigerant flow to lower pressure regions of compressor 112 to reduce the mass flow rate of the refrigerant and thus the load on compressor 112. Embodiments without an economizer are also contemplated.

Chiller system 100 further includes a motor cooling system 200 that includes plumbing 202 selectively connecting condenser 120 and evaporator 130 to a coolant supply line 203. Supply line 203 provides refrigerant to motor assembly 170 and drive 150. Cooling system 200 can include a pump 201 to provide sufficient pressure for refrigerant to flow through the respect motor assembly 170 and drive 150 and recirculate the refrigerant through plumbing 151, 171. As discussed further below, the refrigerant in cooling system 200 can be diverted to various portions of motor assembly 170 to provide cooling of, for example, the stator jacket, motor bearings and motor coils.

Figure 2:
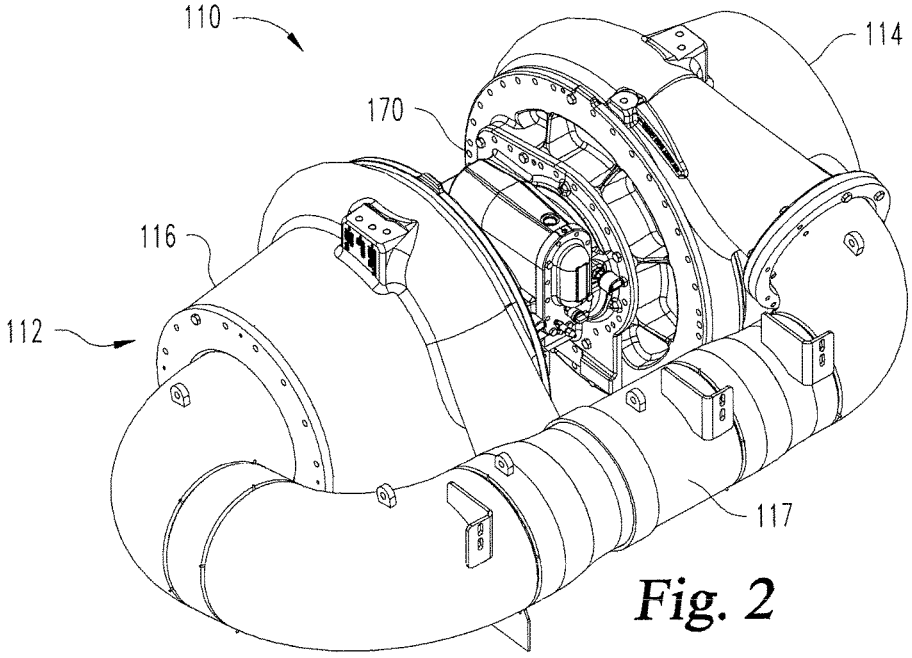
FIG. 2 is a perspective view of a gas compression system of the chiller system of FIG. 1.
Figure 3:
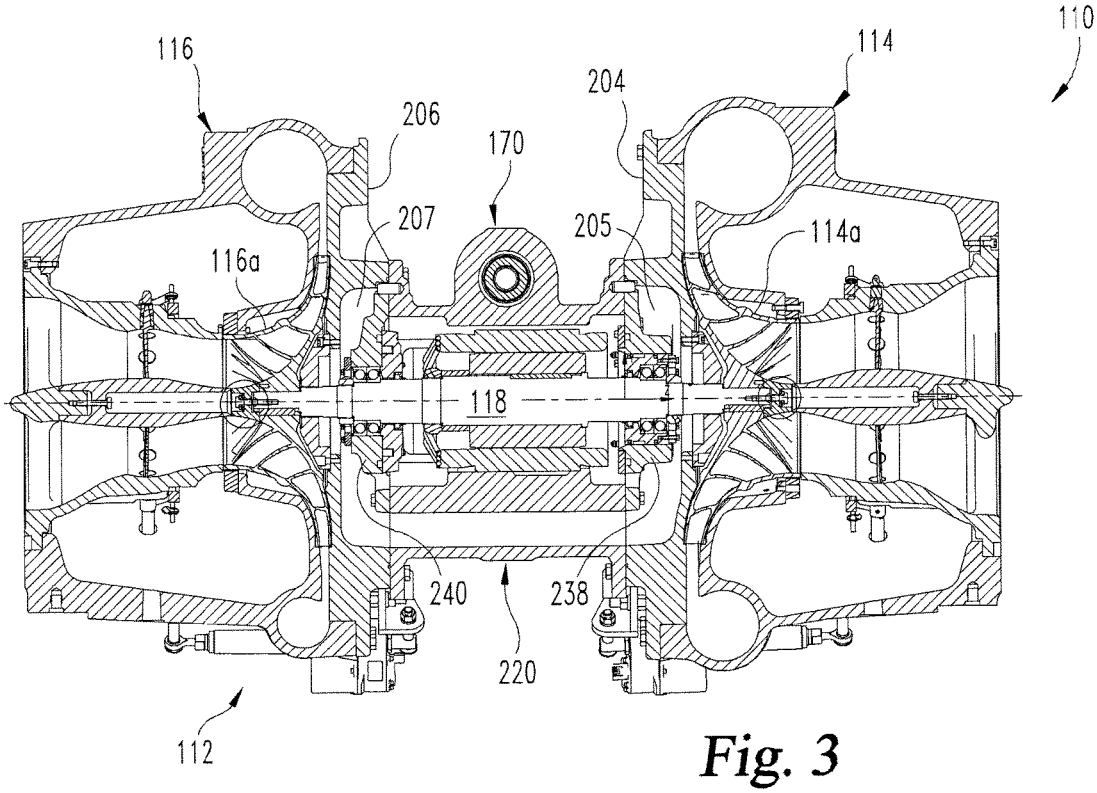
FIG. 3 is a section view of the gas compression system of FIG. 2.
Figure 4:
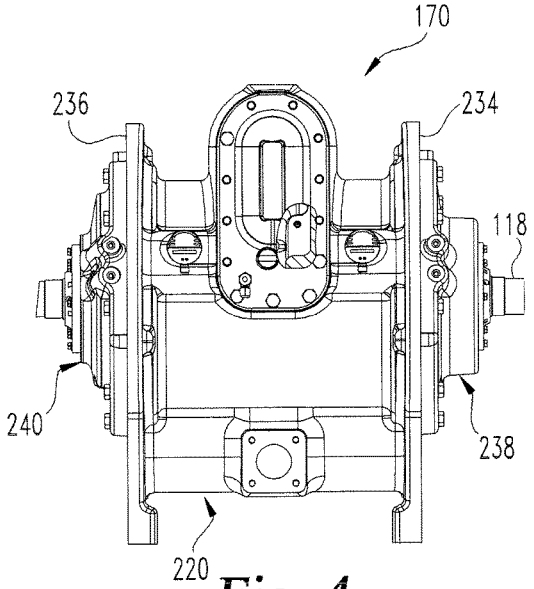
FIG. 4 is an elevation view of a motor assembly of the gas compression system of FIG. 2.
Figure 5:
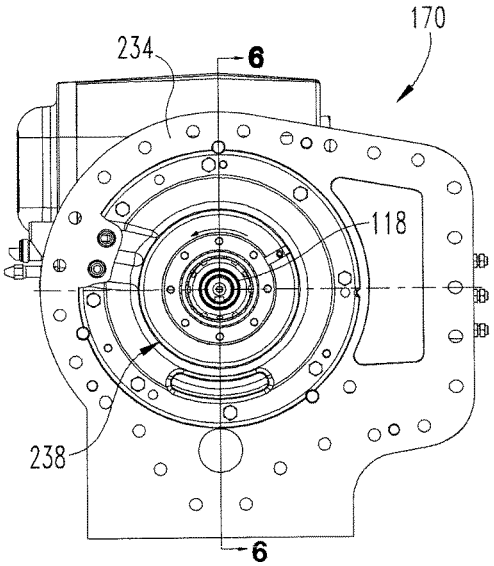
FIG. 5 is a side elevation view of the motor assembly of FIG. 4.
Figure 6:
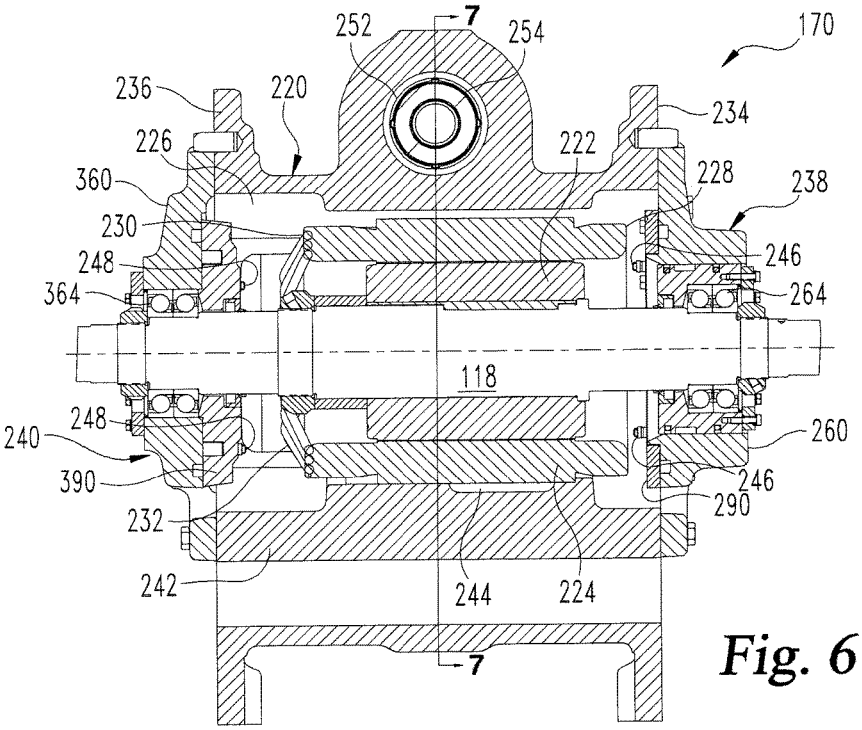
FIG. 6 is a section view of the motor assembly along line 6-6 of FIG. 5.

FIGS. 2 and 3 show gas compression system 110 includes with motor assembly 170 connected between first stage 114 and second stage 116 of a two stage compressor 112. As shown in FIG. 2, first stage 114 includes an outlet connected to an inlet of second stage 116 with plumbing 117. As shown in FIG. 3, compressor 112 further includes enclosure plates 204, 206 that enclose the facing sides of first stage 114 and second stage 116. Enclosure plates 204, 206 further provide platforms for mounting a motor housing 220 of motor assembly 170 to first and second stages 114, 116. Shaft 118 extends through and outwardly from bearing housings 238, 240 at opposite sides of motor housing 220 and through enclosure plates 204, 206 for engagement with respective ones of impellers 114*a*, 116*a*.

Referring to FIGS. 4-8, further details of motor assembly 170 are shown. Motor assembly 170 includes housing 220 that houses a rotor 222 mounted to and rotatable with shaft 118. Rotor 222 is positioned within and separated by an air gap from a stator 224. Housing 220 includes a jacket portion 242 adjacent stator 224 that defines a stator refrigerant path 244 around stator 224 to receive refrigerant to provide cooling for stator 224. Stator 224 is supported in cavity 226 of housing 220 and extends between opposite ends 228, 230 that are spaced inwardly from the opposite sides 234, 236 of housing 220. At least one end 230 of stator 224 includes coil windings 232 that generate heat during operation of motor assembly 170.

Motor assembly 170 further includes first bearing housing 238 mounted to first stage side 234 of housing 220 around shaft 118 and within a recess 205 of first enclosure plate 204. Motor assembly 170 also includes a second bearing housing 240 mounted to second stage side 236 of housing 220 around shaft 118 and within a recess 207 of second enclosure plate 206. Each bearing housing 238, 240 includes at least a portion of the flow path that provides refrigerant from supply line 203 of motor cooling system 200 to the bearings and ends of stator 224. In the illustrated embodiment, each bearing housing 238, 240 includes at least one spray nozzle 246, 248, respectively, fluidly connected to the refrigerant flow path defined by the bearing housing to provide a refrigerant spray to the facing adjacent end 228, 230 of stator 224 and also to the ends of rotor 222 within stator 224. The refrigerant spray from, for example, nozzles 248 also provides cooling of motor coil windings 232. As discussed further below, housing 220 also defines at least a portion of the refrigerant flow path that provides refrigerant from supply line 203 to the flow path defined by bearing housings 238, 240. The flow paths and nozzles distribute refrigerant to the hearings and the ends of the motor in a manner that does not use pumping energy from motor assembly 170. Furthermore, the refrigerant is sprayed with a low velocity on motor assembly 170 over the entire circumference of the stator and rotor, which minimizes the erosion of insulation on the components of motor assembly 170 and also minimizes the potential for refrigerant being presented in the air gap between rotor 222 and stator 224.

Figure 7:
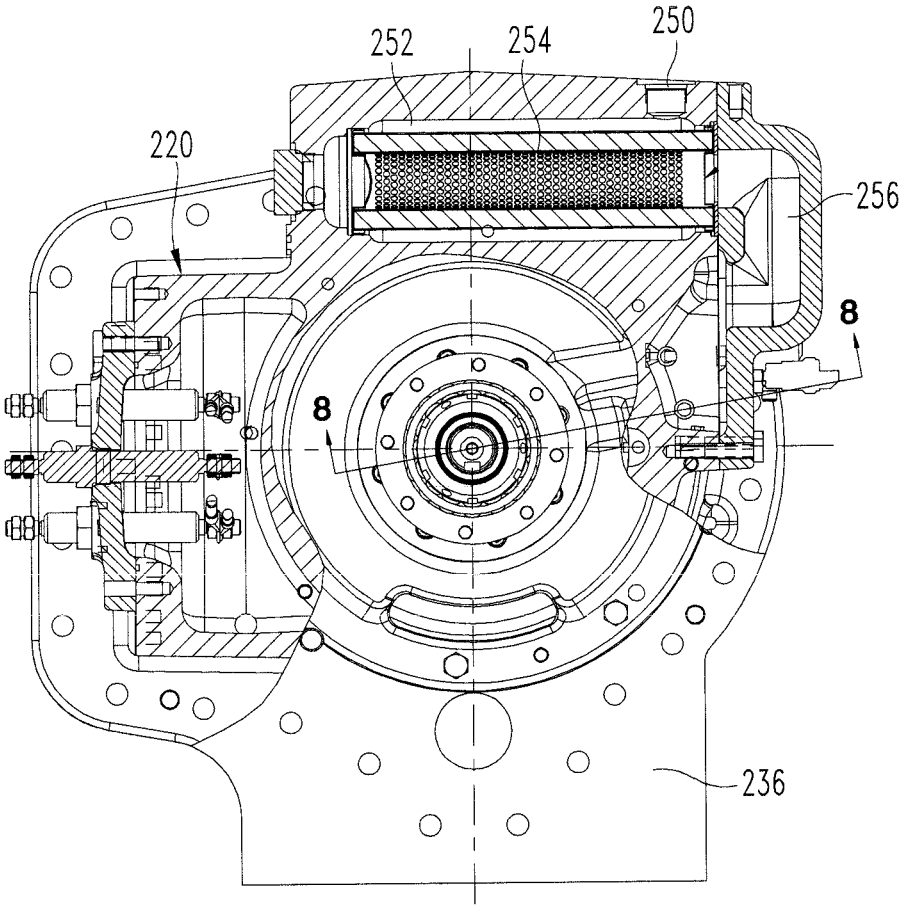
FIG. 7 is a partial section view of the motor assembly along line 7-7 of FIG. 6.

Referring to FIG. 7, motor assembly 170 includes an inlet port 250 for receiving refrigerant from motor cooling system 200 for distribution to nozzles 246, 248, to the bearings of bearing housings 238, 240, and to stator refrigerant path 244. Inlet port 250 is connected to a filter receptacle 252 that houses a filter 254 to filter the refrigerant before delivery to the internal working portions of motor assembly 170. Refrigerant flow from filter 254 outlets to a galley 256 that is connected to the flow paths in housing 220 and bearing housings 238, 240 that provide refrigerant to the bearings, nozzles 246, 248, and stator refrigerant path 244 around stator 224.

Figure 8:
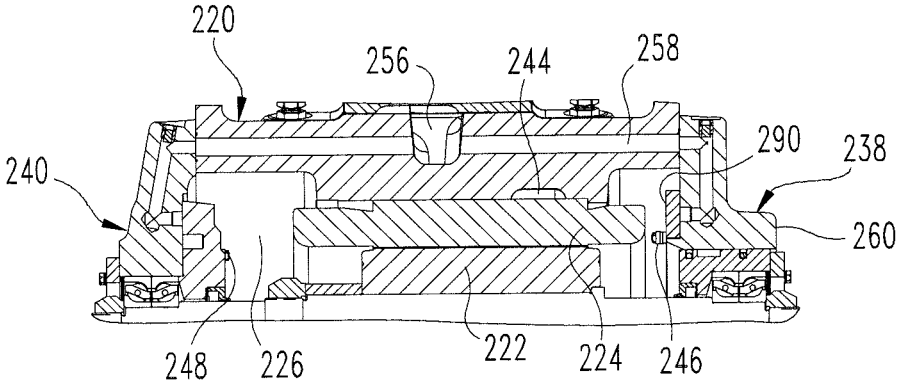
FIG. 8 is a section view of the motor assembly along line 8-8 of FIG. 7.
Figure 9:
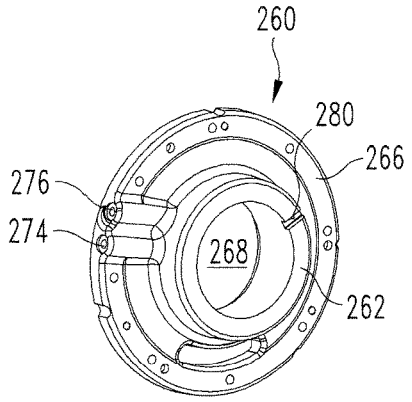
FIG. 9 is a perspective view looking toward an outer side of a hub plate of a bearing housing of the motor assembly that is mounted to the first stage of the compressor.
Figure 10:
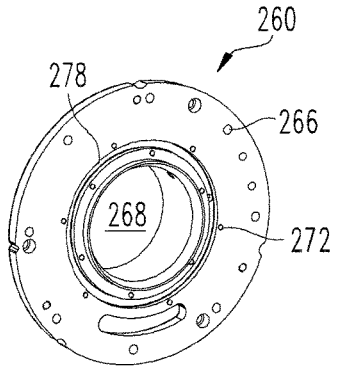
FIG. 10 is a perspective looking toward an inner side of the hub plate of FIG. 9.
Figure 11:
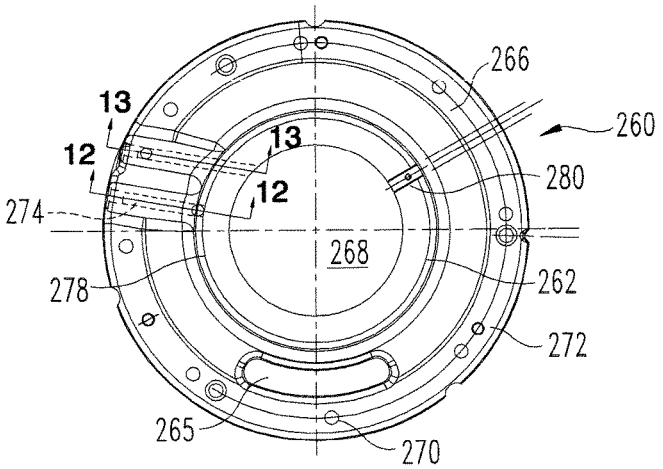
FIG. 11 is an elevation view of the outer side of the hub plate of FIG. 9.
Figure 12:
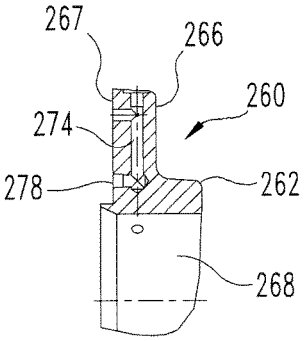
FIG. 12 is a section view of the hub plate along line 12-12 of FIG. 11.
Figure 13:
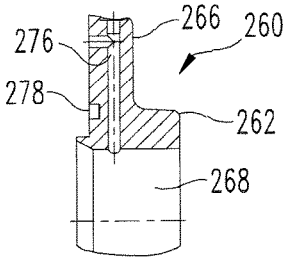
FIG. 13 is a section view of the hub plate along line 13-13 of FIG. 11.

Galley 256 is connected to cross channels in housing 220 that provide a flow of refrigerant to both sides of motor assembly 170. For example, FIG. 8 shows a cross channel 258 that is in fluid communication with flow paths in each of the bearing housings 238, 240. A similar cross channel (not shown) extends across housing 220 to connect flow paths in each of the bearing housings 238, 240 that distribute refrigerant to the bearings housed in bearing housings 238, 240.

FIGS. 9-16 show a hub plate 260 and a distribution ring 290 of first bearing housing 238. Hub plate 260 and distribution ring 290 cooperate to define a refrigerant flow path in bearing housing 238 that distributes refrigerant to nozzles 246 and to the bearing assembly 264 housed in bearing housing 238. Referring to FIGS. 9-13, hub plate 260 includes a central hub portion 262 that defines an annular space 268 to house bearing assembly 264 and shaft 118. Hub plate 260 includes a ring portion 266 extending radially outwardly from hub portion 262. Ring portion 266 defines a number of apertures 270 that receive fasteners to mount hub plate 260 to housing 220 and a number of apertures 272 that receive fasteners to mount distribution ring 290 to hub plate 260. Ring portion 266 also defines a through pocket 265 that allows refrigerant to escape from cavity 226 of motor housing 220 for recirculation through the refrigerant loop.

Ring portion 266 further defines a nozzle flow channel 274 that is in fluid communication with and receives refrigerant from cross channel 258 and delivers the refrigerant to an annular channel 278 extending around central hub portion 262. Ring portion 266 also defines a bearing flow channel 276 that is in fluid communication with and receives refrigerant from the other cross channel in motor housing 220 to provide refrigerant to annular space 268 for cooling of the bearing assembly 264. Central hub portion 262 also defines an outlet groove 280 that allows heated refrigerant to escape from the bearing assembly 264 for return to condenser 120.

Figure 16:
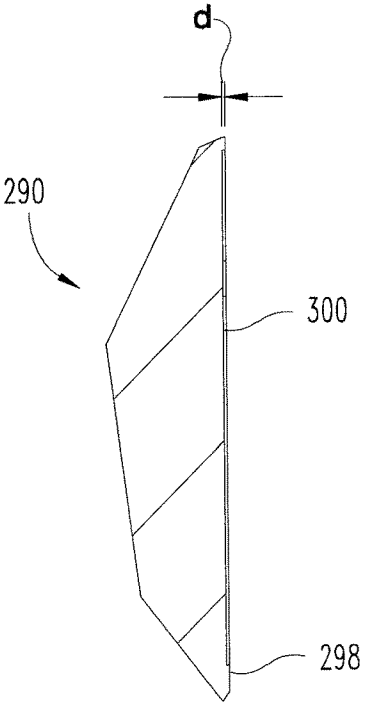
FIG. 16 is an enlarged view of a portion of the distribution ring of FIG. 15.
Figure 15:
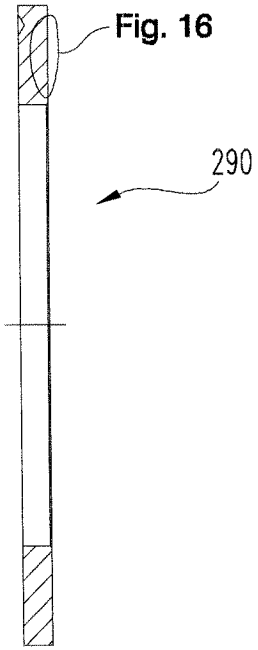
FIG. 15 is a section view of the distribution ring along line 15-15 of FIG. 14.
Figure 14:
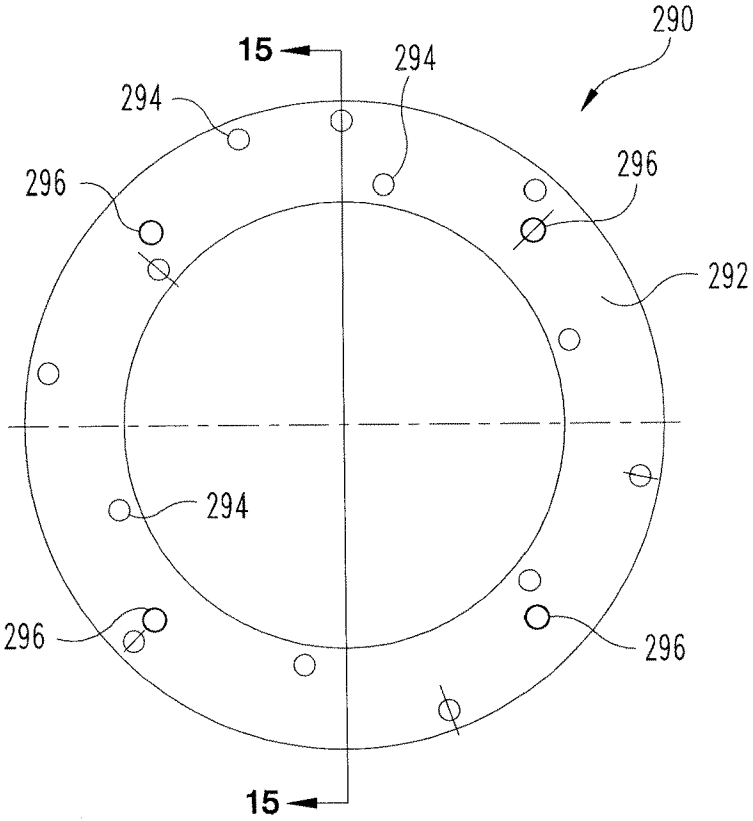
FIG. 14 is an elevation view of an inner side of a distribution ring mountable to the hub plate of FIG. 9.
Figure 17:
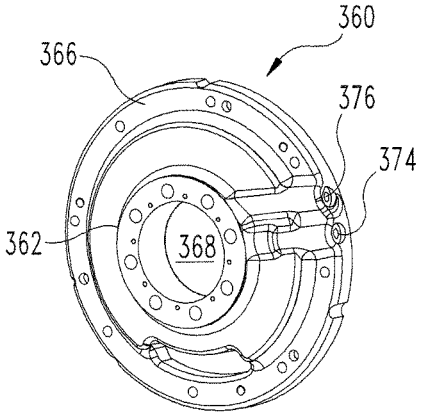
FIG. 17 is a perspective view looking toward an outer side of a second hub plate of the bearing housing of the motor assembly that is mounted to the second stage of the compressor.
Figure 18:
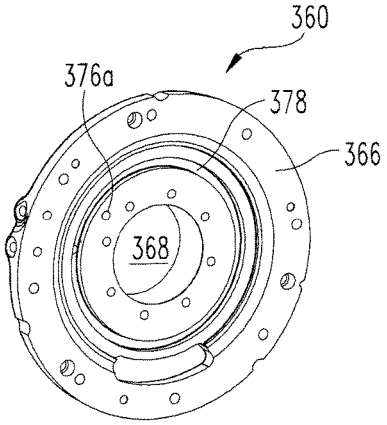
FIG. 18 is a perspective looking toward an inner side of the hub plate of FIG. 17.
Figure 19:
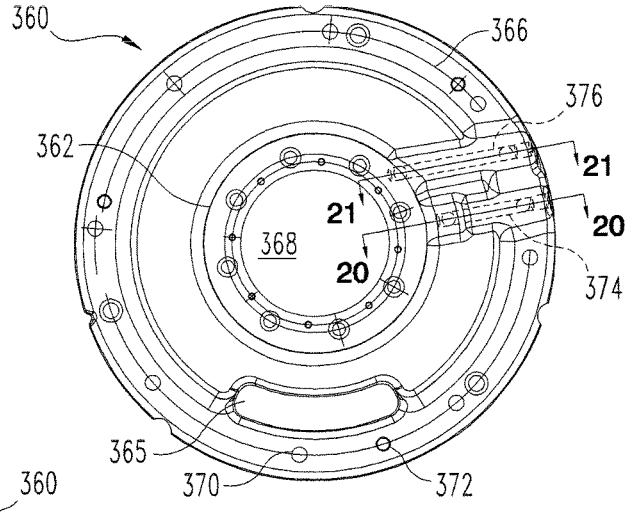
FIG. 19 is an elevation view of the outer side of the hub plate of FIG. 17.
Figure 20:
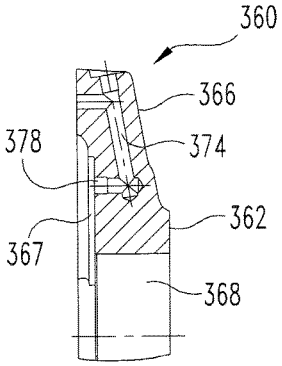
FIG. 20 is a section view of the hub plate along line 20-20 of FIG. 19.
Figure 21:
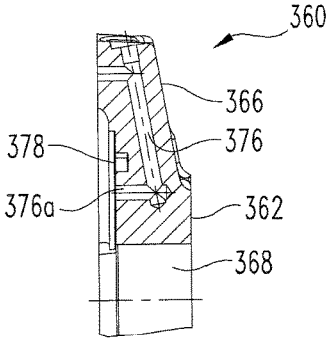
FIG. 21 is a section view of the hub plate along line 21-21 of FIG. 19.
Figure 24:
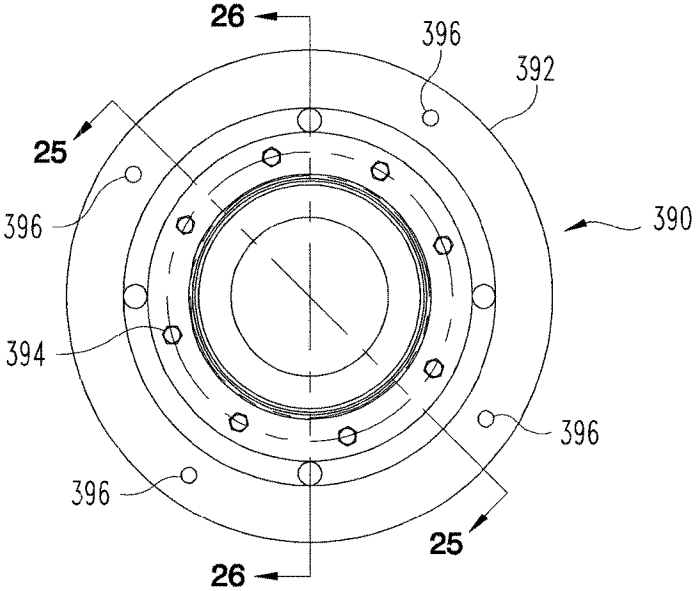
FIG. 24 is an elevation view of the distribution ring of FIG. 23.
Figure 23:
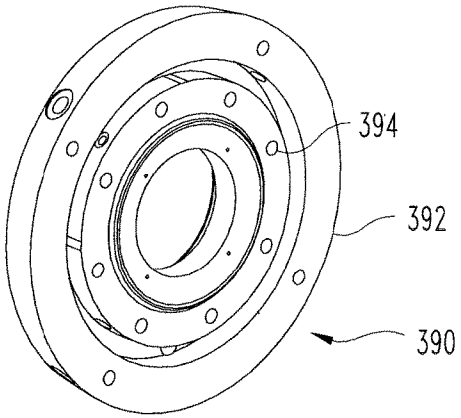
FIG. 23 is a perspective view of the distribution ring looking toward a side of the distribution ring facing the second hub plate of FIG. 17.
Figure 22:
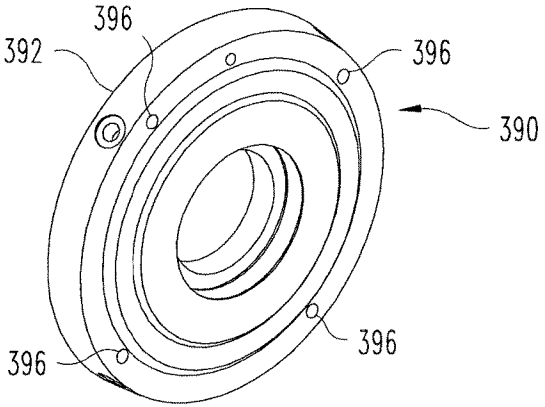
FIG. 22 is a perspective view of a distribution ring mountable to the inner side of the second hub plate of FIG. 17 looking toward the side of the distribution ring facing the motor.

Referring to FIGS. 14-16, distribution ring 290 includes a ring-shaped plate body 292 defining a number of apertures 294 that receive fasteners to secure and sealingly engage a hub side 298 of distribution ring 290 to an inner face 267 of hub plate 260. Plate body 292 also defines a plurality of apertures 296 that receive respective ones of the nozzles 246. As shown in FIGS. 15 and 16, the hub side 298 of plate body 292 includes a recess 300 of a depth d that spaces a portion of hub side 298 away from the adjacent face 267 of ring portion 266 of hub plate 260. Face 267 and recess 300 form an annular flow path that distributes refrigerant around distribution ring 290 to each of the nozzles 246.

Figure 28:
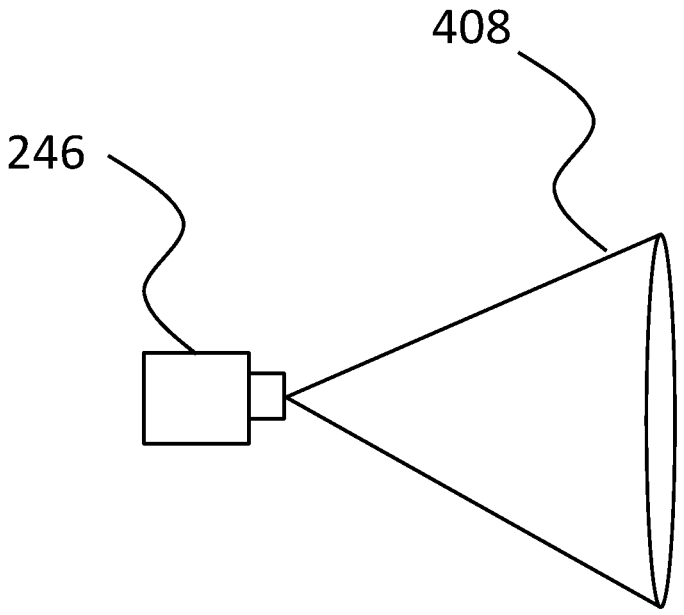
FIG. 28 is a view of a nozzle with conical spray pattern.

In the illustrated embodiment, four nozzles 246 are provided on distribution ring 290 so that the entire adjacent end of rotor 222 and stator 224 receives refrigerant sprayed from nozzles 246. Embodiments in which more or fewer nozzles 246 are provided are also contemplated. Apertures 296 and thus nozzles 246 are spaced equi-angularly around plate body 292 adjacent the perimeter of plate body 292 to form together a nozzle spray pattern that provides 360 degree coverage of the adjacent end of rotor 222, stator 224 and any motor coils 232. In one embodiment, nozzles 246 are threadingly engaged with threads along the respective aperture 296, although other engagement arrangements are also contemplated. In one embodiment, the nozzles 246 can include a conical spray pattern 408 as illustrated in FIG. 28.

FIGS. 17-27 show a hub plate 360 and a distribution ring 390 of second bearing housing 240 that cooperate to define a refrigerant flow path through bearing housing 240 that distributes refrigerant to bearing assembly 364 and nozzles 248. Referring to FIGS. 17-21, hub plate 360 includes a central hub portion 362 that defines an annular space 368 to house bearing assembly 364 and shaft 118, hub plate 360 also includes a tapered ring portion 366 extending and tapering in thickness radially outwardly from hub portion 362. Ring portion 366 defines a number of apertures 370 that receive fasteners to mount hub plate 360 to housing 220 and a number of apertures 372 that receive fasteners to mount distribution ring 390 to hub plate 360. Ring portion 366 also defines a through pocket 365 that allows refrigerant to escape from cavity 226 of motor housing 220 for recirculation through the refrigerant loop.

Ring portion 366 also defines a nozzle flow channel 374 that is in fluid communication with and receives refrigerant from cross channel 258 and delivers the refrigerant to annular channel 378 extending around central hub portion 262. Ring portion 366 also defines a bearing flow channel 376 that delivers refrigerant from the other cross channel in motor housing 220 through outlet **376*a* to annular space 368 for cooling of bearing assembly 364**.

Referring to FIGS. 22-27, distribution ring 390 includes a ring-shaped body 392 defining a passage 393 for receiving shaft 118 therethrough. Body 392 defines a number of apertures 394 that receive fasteners to secure distribution ring 390 to hub plate 360. Plate body 392 also defines a plurality of apertures 396 that receive respective ones of the nozzles 248. Apertures 396 and thus nozzles 248 are spaced equi-angularly around plate body 392 adjacent the perimeter of plate body 392 to form together a spray pattern that provides 360 degree coverage of the adjacent end of stator 226 and motor coils 232. In one embodiment, nozzles 248 are threadingly engaged with threads along the respective aperture 396, although other engagement arrangements are also contemplated. While four nozzles 248 are shown in the illustrated embodiment, embodiments in which more or fewer nozzles 248 are provided are also contemplated.

As shown in FIGS. 26 and 27, the hub side 398 of plate body 392 includes a recess 400 formed by an angled surface that extends inwardly at an angle $\alpha$ that spaces a portion of hub side 398 away from adjacent face 367 of ring portion of hub plate 260. Face 367 and recess 400 form an annular flow path that distributes refrigerant around distribution ring 390 to each of the nozzles 248. Plate body 392 also defines a distribution channel 402 extending therearound that receives refrigerant from bearing flow channel 376. Distribution channel 402 includes opposite axial channels 404 having outlets 406 for delivering refrigerant to bearing assembly 364.

In one embodiment, nozzles 246, 248 are configured to provide a wide angle solid cone-shaped spray pattern with spray angles ranging from 120 to 125 degrees at 10 psi. However, other embodiments contemplate other types of nozzles that provide refrigerant to the ends of the rotor and stator ends of motor assembly 170.

It shall be understood that the exemplary embodiments summarized and described in detail above and illustrated in the figures are illustrative and not limiting or restrictive. Only the presently preferred embodiments have been shown and described and all changes and modifications that come within the scope of the invention are to be protected. It shall be appreciated that the embodiments and forms described below may be combined in certain instances and may be exclusive of one another in other instances. Likewise, it shall be appreciated that the embodiments and forms described below may or may not be combined with other aspects and features disclosed elsewhere herein. It should be understood that various features and aspects of the embodiments described above may not be necessary and embodiments lacking the same are also protected. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A chiller system comprising:

a refrigeration loop for circulating refrigerant, the refrigeration loop including a gas compression system, a condenser, and an evaporator, wherein the gas compression system includes a compressor for compressing the refrigerant and a motor assembly for driving the compressor, wherein the motor assembly includes:

a motor and a motor housing that houses a stator and a rotor, wherein at least a portion of the motor is rotatable within the motor housing by a shaft that extends from at least one end of the motor to the compressor;

a bearing housing connecting the shaft to the compressor; and a motor cooling system connecting the refrigeration loop to the motor assembly to provide refrigerant for cooling the motor, wherein the motor cooling system includes a plurality of nozzles within the motor housing for spraying refrigerant on the at least one end of the motor;

wherein the plurality of nozzles each provide a conical spray pattern and together the spray patterns of the plurality of nozzles entirely cover the at least one end of the motor, where the at least one end of the motor includes an end of the stator and an end of the rotor such that the conical spray pattern of each individual one of the plurality of nozzles provides refrigerant to the end of the stator and the end of the rotor.

2. The system of claim 1, wherein the motor includes a rotor connected to the shaft, the stator around the rotor, and the motor cooling system includes a jacket around the stator to form a refrigerant flow path around the stator.

3. The system of claim 2, wherein the motor cooling system includes a second flow path in the bearing housing to provide refrigerant to a bearing assembly within the bearing housing.

4. The system of claim 1, wherein the motor housing defines at least a portion of a refrigerant flow path that extends from an inlet to the motor housing to the plurality of nozzles.

5. The system of claim 4, wherein the bearing housing defines a second portion of the refrigerant flow path that extends from the portion of the refrigerant flow path in the motor housing to the plurality of nozzles.

6. The system of claim 5, wherein the bearing housing includes a hub plate defining a nozzle flow channel that is in fluid communication with the portion of the refrigerant flow path defined by the motor housing, the bearing housing further including a distribution ring mounted to the hub plate between the hub plate and the at least one end of the motor, and the plurality of nozzles are engaged to the distribution ring in fluid communication with the nozzle flow channel.

7. The system of claim 6, wherein the distribution ring includes a first surface facing the hub plate and a recess in the first surface of the distribution ring forms a distribution channel with the hub plate to provide refrigerant flow from the nozzle flow channel of the hub plate to the plurality of nozzles.

8. The system of claim 7, wherein the plurality of nozzles are positioned adjacent a perimeter of the distribution ring and the distribution channel fluidly connects the nozzle flow path to each of the nozzles.

9. The system of claim 1, further comprising a second bearing housing connecting the shaft to another stage of the compressor adjacent a second end of the motor opposite the at least one end, and wherein the motor cooling system further includes at least one nozzle connected to the second bearing housing for spraying refrigerant on the second end of the motor.

10. The system of claim 9, wherein the motor includes a plurality of coils on at least one of the ends of the motor and the plurality of coils receive refrigerant spray from the plurality of nozzles adjacent thereto.

11. A gas compression system comprising:

a motor assembly including a motor housing defining a cavity, a motor in the cavity where the motor includes a stator and a rotor, and a shaft extending from a first end of the motor, wherein the shaft is rotatable by operation of the motor, the motor assembly further including a bearing housing connected to the shaft adjacent the first end of the motor;

a compressor including at least one stage connected to the motor housing with the shafl: and the bearing housing rotatably coupling an impeller of the compressor to the motor; and a motor cooling system including a coolant loop connected to the motor assembly to provide coolant for cooling the motor, wherein the motor cooling system includes a plurality of nozzles within the motor housing for spraying refrigerant on the first end of the motor;

wherein the plurality of nozzles each provide a conical spray pattern and together the spray patterns entirely cover the first end of the motor, wherein the first end of the motor includes an end of the stator and an end of the rotor, and wherein the conical spray pattern of each individual one of the plurality of nozzles provides coolant to the end of the stator and the end of the rotor.

12. The system of claim 11, wherein the plurality of nozzles is connected to and received refrigerant flow from the bearing housing.

13. The system of claim 11, wherein the motor housing defines at least a portion of a refrigerant flow path from an inlet to the motor housing to the plurality of nozzles.

14. The system of claim 13, wherein the bearing housing defines a second portion of the refrigerant flow path that extends from the portion of the refrigerant flow path in the motor housing to the plurality of nozzles.

15. The system of claim 14, wherein the bearing housing includes a hub plate defining a nozzle flow channel that is in fluid communication with the portion of the refrigerant flow path defined by the motor housing, the bearing housing further including a distribution ring mounted to the hub plate between the hub plate and the first end of the motor, and the plurality of nozzles are engaged to the distribution ring in fluid communication with refrigerant from the nozzle flow channel.

16. The system of claim 11, further comprising a second bearing housing connecting the shaft to a second stage of the compressor adjacent a second end of the motor that is opposite the first end, and wherein the motor cooling system further includes at least one nozzle within the motor housing for spraying refrigerant on the second end of the motor.

17. The system of claim 16, wherein each of the plurality of nozzles adjacent respective ones of the first and second ends of the motor are connected to respective ones of the bearing housings.

18. A method, comprising:

spraying refrigerant from a plurality of nozzles on at least one end of a motor housed in a motor housing of a motor assembly to provide cooling of the motor during operation of the motor, the motor including a stator and a rotor; and providing a conical spray pattern from each of the plurality of nozzles, where together the spray patterns from each of the plurality of nozzles entirely cover the at least one end of the motor, where the at least one end of the motor includes an end of the stator and an end of the rotor such that the conical spray pattern of each individual one of the plurality of nozzles provides refrigerant to the end of the stator and the end of the rotor.

19. The method of claim 18, further comprising spraying each end of the motor of the motor assembly to provide cooling of the motor during operation of the motor.

20. The method of claim 18, further comprising spraying coils of the motor with the refrigerant during operation of the motor.

21. The method of claim 18, wherein the refrigerant is provided from a refrigeration loop of a chiller system connected to the motor assembly.

22. The method of claim 18, wherein the motor assembly is operably connected to a compressor.

* * * * *